US005925235A

United States Patent [19]

Habib

[11] Patent Number: 5,925,235

[45] Date of Patent: Jul. 20, 1999

[54] MIDDLE DISTILLATE SELECTIVE HYDROCRACKING PROCESS

[75] Inventor: Mohammad M. Habib, Benicia, Calif.

[73] Assignee: Chevron U.S.A. Inc., San Francisco, Calif.

[21] Appl. No.: 09/178,159

[22] Filed: Oct. 23, 1998

Related U.S. Application Data

[ 60] Provisional application No. 60/068,413, Dec. 22, 1997.

[51] Int. Cl.[6] ..... C10G 47/16

[52] U.S. Cl. ..... 208/111.35; 208/111.3; 208/108; 208/110; 208/112; 208/143; 208/216 PP; 208/217; 208/209; 208/216 R

[58] Field of Search ..... 208/111.35, 111.3, 208/216 PP, 143, 217, 110, 112

[56] References Cited

U.S. PATENT DOCUMENTS

| | | | |
|---|---|---|---|
| 4,820,402 | 4/1989 | Partridge et al. | 208/111 |
| 4,990,243 | 2/1991 | Winslow et al. | 208/254 |
| 5,171,422 | 12/1992 | Kirker et al. | 208/111 |
| 5,393,410 | 2/1995 | Habib et al. | 208/111 |
| 5,401,704 | 3/1995 | Absil et al. | 502/66 |
| 5,439,860 | 8/1995 | Habib et al. | 502/66 |
| 5,565,088 | 10/1996 | Nair et al. | 208/58 |
| 5,593,570 | 1/1997 | Habib et al. | 208/108 |
| 5,620,590 | 4/1997 | Absil et al. | 208/111 |

*Primary Examiner*—Helane Myers
*Attorney, Agent, or Firm*—Alan W. Klaassen

[57] ABSTRACT

A layered hydrocracking catalyst system has high middle distillate selectivity when used for hydrocracking a high sulfur and high nitrogen containing feedstock. The layered system comprises a first layer catalyst with contains a zeolite having a unit cell size of greater than about 24.35 Angstroms, and a second layer catalyst which contains a zeolite having a unit cell size of less than about 24.30 Angstroms. The layered system is particularly beneficial in terms of catalyst life and product selectivity for reactors operated under conditions of a high temperature profile.

19 Claims, 2 Drawing Sheets

MIDDLE DISTILLATE SELECTIVE HYDROCRACKING PROCESS

This Patent Application claims priority from U.S. Provisional patent applicaton Ser. No. 60/068,413 filed Dec. 22, 1997, the specification of which is incorporated herein by reference for all purposes.

FIELD OF THE INVENTION

The present invention is directed to a hydrocracking process, and particularly to a hydrocracking process for producing middle distillate fuels.

BACKGROUND OF THE INVENTION

Hydrocracking is an important process for producing middle distillate fuels from heavier feedstocks, such as vacuum gas oils. In the hydrocracking process, heavy feeds, which generally contain relatively large amounts of sulfur and nitrogen, are cracked into lighter, lower boiling hydrocrackate products for use as fuels, petrochemical feedstocks, and other petroleum refinery products. Hydrocracking catalysts are generally selected for high cracking activity, and for resisting the poisoning effects of the sulfur and nitrogen-containing materials in the feedstock. To this end, Y-type zeolites are often included as components of the hydrocracking catalyst. These zeolites catalyze cracking reactions at much higher rates than amorphous (i.e. non-zeolitic) catalysts. In addition, Y-type zeolites can be tailored to provide a range of cracking activity, depending, for example, on the relative amounts of silica and alumina in the crystalline matrix of the zeolite. Zeolites with a low $SiO_2/Al_2O_3$ ratio exhibit high cracking activity. As the alumina is removed from the crystalline matrix by methods known to the art, the $SiO_2/Al_2O_3$ increases, and the relative cracking activity decreases. The unit cell size of the crystalline zeolite also tends to decrease with increasing $SiO_2/Al_2O_3$ ratios. Zeolites with a relatively large unit cell size have high cracking activity. By reducing the unit cell size using methods known in the art, the cracking activity decreases. However, it is possible to exploit the decrease in activity to tailor a catalyst which provides a higher selectivity of a desired cracked product. Methods have also been developed to produce zeolites having increasingly smaller crystallite sizes, and the published literature teach the use of these small crystallite size zeolites for hydrocarbon conversion processes.

U.S. Pat. No. 5,401,704 discloses a hydrocracking process using a catalyst comprising zeolite Y and a combination of hydrogenating metals, where the zeolite Y has a crystal size of from about 0.1 to about 0.5 microns. According to U.S. Pat. No. 5,401,704, the small crystal Y zeolite provides high selectivity for producing $C_5$–165° C. naphtha.

A number of patents disclose hydrocracking and/or hydrotreating processes using zeolite containing catalysts, the zeolite component having relatively high $SiO_2/Al_2O_3$ ratios or relatively small unit cell sizes. For example, Kirker, in U.S. Pat. No. 5,171,422 teaches hydrocracking a feedstock with a catalyst comprising a zeolite of the faujasite structure possessing a framework silica: alumina ratio of at least about 50:1.

Partridge, et al., in U.S. Pat. No. 4,820,402, teaches a hydrocracking process using a catalyst comprising a hydrogenation component and a zeolite which has pores with a dimension greater than 6 Angstroms and a hydrocarbon sorption capacity for hexane of at least 6 percent and has a framework silica:alumina ratio of at least about 50:1.

Partridge, et al., further suggest that the selectivity for production of the higher boiling distilled range product is preferentially increased in the hydrocracking process.

Absil, et al., in U.S. Pat. Nos. 5,401,704 and 5,620,590 teaches a catalyst comprising a zeolite Y with a crystal size of from about 0.1 to about 0.5 microns and a unit cell size of 24.5 Angstroms or less for hydrocracking a variety of feedstock.

U.S. Pat. No. 5,565,088, issued to Nair, et al., discloses a process for upgrading middle distillates by hydrocracking a feedstream boiling above 350° C. with a hydrocracking catalyst comprising a Y zeolite, and contacting the product stream with a dewaxing catalyst comprising an intermediate pore non-zeolitic molecular sieve material and from about 0.1 to about 0.75 wt % of a sulfided non-noble metal hydrogenation component. A Y-type zeolite preferred by Nair, et al., possesses a unit cell size between about 24.20 Angstroms and 24.45 Angstroms.

Others describe layered catalyst systems. For example, Winslow, et al., in U.S. Pat. No. 4,990,243 teaches a denitrification process using a layered catalyst system comprising a first layer of a catalyst which comprises a nickel-molybdenum-phosphorous/alumina catalyst or a cobalt-molybdenum-phosphorous/alumina catalyst and comprising a second layer of a catalyst which comprises a nickel-tungsten/silica-alumina-zeolite or a nickel-molybdenum/silica-alumina-zeolite catalyst. Habib et al., in U.S. Pat. Nos. 5,439,860 and 5,593,570 teach a dual function catalyst system for combined hydrotreating and hydrocracking process operations using randomly intermixed hydrodenitrification and/or hydrodesulfurization catalyst and hydrocracking catalyst. The preferred hydrocracking catalyst of Habib, et al. comprises a Y zeolite having a unit cell size greater than about 24.55 Angstroms and a crystal size less than about 2.8 microns. Habib, et al., in U.S. Pat. No. 5,393,410 teaches a conversion process using catalyst comprising an ultra stable Y zeolite base, wherein the Y zeolite has a unit cell size greater than about 24.55 Angstroms and a crystal size less than about 2.8 microns.

While the catalysts described in the patents listed above have high cracking activity, the need remains for a catalyst system which can maintain adequate catalyst life while producing higher amounts of the desired hydrocracked product.

During hydrocracking within a catalytic reaction zone a petroleum feedstock is introduced into the zone at a first reaction temperature. As the reacting oil passes through the zone, exothermic hydrocracking reactions increase the temperature of the oil and of the catalyst which the oil contacts, so that the temperature in the zone increases through the zone in the direction of flow of oil. Thus, a steep temperature profile through the zone indicates a rapid temperature increase through the zone. Methods of adjusting the temperature, e.g. adding cool quench hydrogen or quench oil at intermediate locations in the zone, are known and commonly practiced. However, the amount of heat generated by reaction is such that a second reaction temperature, which is the temperature of the oil exiting the zone, is generally higher than the first reaction temperature. In a hydrocracking reactor which contains a layered catalyst system, there is a generally increasing temperature profile through the entire system, such that a second reactor temperature, which is the temperature of the oil exiting the system, is higher than the first reaction temperature. While hydrocracking at a high exit temperature, and with a steep temperature profile along the hydrocracking reactor, often causes significant reduction in reaction selectivity, results in poor product quality, and leads to reduced catalyst life, the refiner is often constrained to run the hydrocracker at such conditions for processing, economic, or other reasons. A more selective catalyst system for operating under a steep temperature profile is desired.

SUMMARY OF THE INVENTION

The present invention is directed to a layered catalyst system and a hydrocracking process using the layered catalyst system. An object of the invention is to provide a catalytic system and process with superior selectivity for producing middle distillate fuel at low cost. Zeolites having a high unit cell size provide active cracking at low cost, but at the expense of low selectivity to middle distillate fuels. Zeolites having a low unit cell size are relatively more expensive, and tend to foul faster, but they have superior middle distillate selectivity. Among other factors, the present invention is based on the discovery that a reaction system having a high unit cell size zeolite may be modified by the addition of a layer of a low unit cell size zeolite catalyst to produce a system having superior selectivity without sacrificing catalyst activity or catalyst life. The layered catalyst system comprises a first catalyst layer which contains catalyst particles comprising a Y-type zeolite having a unit cell size of greater than about 24.35 Angstroms and a second catalyst layer which contains catalyst particles comprising a Y-type zeolite having a unit cell size of less than about 24.30 Angstroms.

In a preferred embodiment, the present invention is directed to a hydrocracking process contacting a petroleum feedstock and hydrogen at hydrocracking conditions with a first catalyst layer which contains catalyst particles comprising a Y-type zeolite having a unit cell size of greater than about 24.35 Angstroms and contacting the entire effluent from the first catalyst layer at hydrocracking conditions with a second catalyst layer which contains catalyst particles comprising a Y-type zeolite having a unit cell size of less than about 24.30 Angstroms.

The layered catalyst system has been found to be particularly effective when operated in a hydrocracking process under conditions of a high temperature profile. Thus, the present invention further provides a hydrocracking process comprising contacting a petroleum feedstock with hydrogen at hydrocracking reaction conditions, including a first reaction temperature, over a first layer catalyst comprising a Y-type zeolite having a unit cell size of greater than about 24.35 Angstroms, and contacting at least a portion of the effluent from the first layer catalyst with hydrogen at hydrocracking reaction conditions, including a second reaction temperature, over a second layer catalyst comprising a Y-type zeolite having a unit cell size of less than about 24.30 Angstroms, wherein the second reaction temperature is at least about 40° F. higher that the first reaction temperature.

Further to the invention is a layered catalyst system comprising a first catalyst layer which contains catalyst particles comprising a Y-type zeolite having a unit cell size of greater than about 24.35 Angstroms and a second catalyst layer which contains catalyst particles comprising a Y-type zeolite having a unit cell size of less than about 24.30 Angstroms. The first catalyst layer may optionally also contain amorphous catalyst particles, and the second catalyst layer may optionally also contain amorphous catalyst particles.

IN THE DRAWINGS

FIG. 1 compares the jet fuel selectivity of the present layered catalyst system with single layer catalyst systems.

FIG. 2 compares catalyst stability and catalyst fouling rates of the present layered catalyst system with single layer catalyst systems.

DETAILED DESCRIPTION OF THE INVENTION

Figure 1:
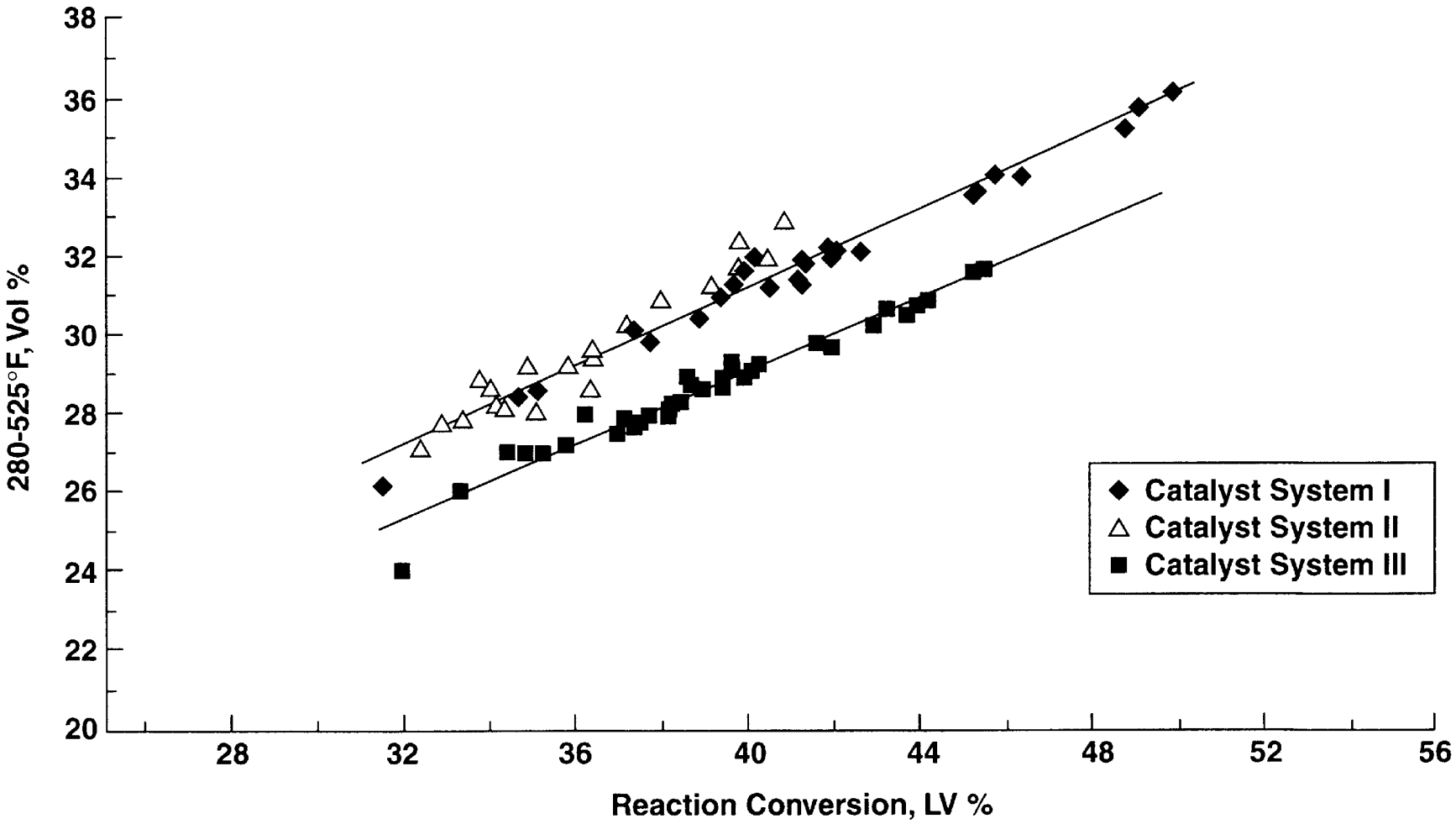

Those familiar with the art related to the present invention will appreciate the full scope of the catalyst system and the process summarized above and be able to practice the present invention over its full scope from a detailed description of the principal features of the catalyst system and process which follows.

The layered catalyst system comprises two different and distinct layers of catalyst particles. Each of the two catalyst layers is distinguished by a different Y-type zeolite. A first layer comprises a catalyst containing a first Y-type zeolite, characterized by a unit cell size of greater than about 24.35 Angstroms. This zeolite is generally employed in hydrocracking for high cracking activity and for catalyst stability and life. A second layer comprises a catalyst containing a second Y-type zeolite, characterized by a unit cell size of less than about 24.30 Angstroms. This zeolite is generally employed in hydrocracking to provide greater middle distillate selectivity, but generally at lower cracking activity and at the expense of shorter catalyst life.

The subject process is especially useful in the production of middle distillate fractions boiling in the range of about 250°–700° F. (121°–371° C.) as determine by the appropriate ASTM test procedure. The term "middle distillate" is intended to include the diesel, jet fuel and kerosene boiling range fractions. The kerosene or jet fuel boiling point range is intended to refer to a temperature range of about 280°–525° F. (138°–274° C.) and the term "diesel boiling range" is intended to refer to hydrocarbon boiling points of about 250°–700° F. (121°–371° C.). Gasoline or naphtha is normally the $C_5$ to 400° F. (204° C.) endpoint fraction of available hydrocarbons. The boiling point ranges of the various product fractions recovered in any particular refinery will vary with such factors as the characteristics of the crude oil source, refinery local markets, product prices, etc. Reference is made to ASTM standards D-975 and D-3699-83 for further details on kerosene and diesel fuel properties.

The hydrocracking process involves conversion of a petroleum feedstock by, for example, molecular weight reduction via cracking, molecular rearrangement by alkylation, disproportionation and the like, hydrogenation of olefins and aromatics, and removal of nitrogen, sulfur and other heteroatoms. The process may be controlled to a certain cracking conversion or to a desired product sulfur level or nitrogen level or both. Conversion is generally related to a reference temperature, such as, for example, the minimum boiling point temperature of the hydrocracker feedstock. The extent of conversion relates to the percentage of feed boiling above the reference temperature which is converted during hydrocracking into hydrocrackate boiling below the reference temperature.

The present process is suitable for hydrocracking in either a single stage, as either a first stage or a second stage in a two stage hydrocracking system, or as one stage in a multiple stage hydrocracking system. In a multiple stage hydrocracking system, the hydrocracker effluent from one (e.g. the first) stage is separated into at least one liquid and one hydrogen rich gaseous component, with at least some of the liquid, along with purified hydrogen, being supplied as feedstock to a second (or subsequent) stage. In multiple stage hydrocracking systems, the first stage is designed to promote sulfur and nitrogen removal, though some cracking occurs as well. The following second stage is designed to promote cracking reactions, though some saturation, sulfur removal and nitrogen removal also occur. The process is useful in either upflow or downflow operation.

Petroleum feedstocks useful in the present process include those commonly used for hydrocracking. Representative feedstocks include petroleum crude oils, topped or reduced crude oils, solvent deasphalted oils, distillates, gas oils and vacuum gas oils, etc. Typical feedstocks for passage into the first stage hydrocracking reaction zone include virtually any heavy mineral or synthetic oil and fractions thereof Thus, such feedstocks as straight run gas oils, vacuum gas oils, demetallized oils, deasphalted vacuum residue, coker distillates, cat cracker distillates, shale oil, tar sand oil, coal liquids and the like are contemplated. The feedstock may have been processed, e.g. by hydrotreating, prior to the present hydrocracking process. The preferred feedstock will have a boiling point range starting at a temperature above 160° C. but would not contain appreciable asphaltenes. The feed stream should have a boiling point range between 260–620° C. Preferred first stage feedstocks therefore include gas oils having at least 60% volume of their components boiling above 371° C. (700° F.). The hydrocracking feedstock may contain nitrogen, usually present as organonitrogen compounds in amounts greater than 1 ppm. However, it is a feature of the present invention that high nitrogen feeds, e.g. containing greater than 100 ppm, or greater than 200 ppm or up to 5000 ppm and higher, of organonitrogen may be treated in the present process. The feed will normally also contain sulfur containing compounds sufficient to provide a sulfur content greater than 0.15 wt %, including feeds having a sulfur content of up to 2 wt % and higher. It may also contain mono- and/or polynuclear aromatic compounds in amounts of up to 50 volume percent and higher. The petroleum feedstock can be treated prior to hydrocracking to reduce or substantially eliminate its heteroatom content.

The hydrocracking process comprises contacting the petroleum feedstock at hydrocracking conditions with hydrogen over the layered catalyst system. The feedstock will generally be preheated prior to introduction to the reaction zone containing the layered catalyst system. A gaseous reactant added to the feed prior to the reaction zone comprises hydrogen, sometimes containing small amounts of diluents such as nitrogen or light hydrocarbons. Such hydrogen streams originate from, for example, a hydrogen plant, a reforming reactor, or as hydrogen recycled from the hydrocracker effluent. Purity of the gaseous stream will depend on a number of factors, but will generally be greater than 50% hydrogen, and often greater than about 90% hydrogen or higher.

Hydrocracking conditions include a reaction temperature in the range of from about 250° C. to about 500° C., pressures up to about 300 bar (30.5 MPa) and a feed rate (vol oil/vol cat h) from about 0.1 to about 10 $hr^{-1}$. Hydrogen circulation rates are generally in the range from about 350 std liters $H_2$/kg oil to 1780 std liters $H_2$/kg oil. Preferred reaction temperatures range from about 340° C. to about 455° C. Preferred total reaction pressures range from about 500 pounds per square inch absolute (psia) to about 3,500 psia (about 3.5 MPa–about 24.2 MPa), preferably from about 1,000 psia to about 3,000 psia (about 7.0 MPa–about 20.8 MPa).

With the preferred catalyst system described above, it has been found that preferred process conditions include contacting a petroleum feedstock with hydrogen in the presence of the layered catalyst system under hydrocracking conditions comprising a pressure of about 16.0 MPa (2,300 psia), a gas to oil ratio at from about 606–908 std liters $H_2$/kg oil (4,000 scf/bbl to about 6,000 scf/bb)l, a LHSV of about 1.0 $hr^{-1}$, and a temperature in the range of 360° C. to 427° C. (680° F.–800° F.).

In the hydrocracking process using the present layered catalyst system, the effluent from the hydrocracking reaction zone is enriched in middle distillate products. By middle distillate selectivity is meant the ratio of hydrocracker effluent products boiling in the middle distillate range relative to the total hydrocracker hydrocarbonaceous effluent. In the use of the present layered catalyst system for hydrocracking a petroleum feedstock, the middle distillate selectivity of the catalyst system is superior to that of conventional catalyst systems.

The effluent from the hydrocracking process using the layered catalyst system of the present invention contains cracked products having a boiling point below that of the petroleum feedstock to the hydrocracking process. The hydrocracker effluent is further decreased in nitrogen and sulfur content, preferably containing less than about 200 ppm sulfur and less than about 50 ppm nitrogen. The preferred hydrocracker effluent is further reduced in boiling point, such that at least 5%, more preferably at least about 10% by volume and still more preferably at least about 30% by volume of the petroleum feedstock boiling above 525° F. is converted to hydrocracked products which boil below about 525° F.

The layered catalyst system may be suitably maintained during hydrocracking at isothermal conditions, i.e. the temperature of the layered catalyst system is uniform throughout. However, the hydrocracking process with the layered catalyst system is particularly suited for operation with an increasing temperature profile, and the performance of the layered system, relative to conventional catalyst systems, improves as the temperature profile increases. Temperature profiles of greater than 10° F., or 25° F., or 40° F., or even 75° F. are suitable for the present process. While the temperature profile may be affected through cooling the layered catalyst system, by the addition of cool hydrogen to the layered catalyst system, and/or by the addition of cool oil to the layered catalyst system, the temperature of the layered catalyst system at the location at which the reacting oil exits the system will generally be higher than the temperature at the location where the reacting oil enters the system.

In a preferred method of practicing the present invention, a petroleum feedstock is heated to a reaction temperature and introduced to a catalytic reaction zone which contains the present layered catalyst system. The reaction zone may additionally include other layers of catalytic particles, including, for example, guard bed layer(s) for removing catalyst foulants from the petroleum feedstock and/or layer (s) of hydrotreating catalysts for removing metals, sulfur, nitrogen, etc., from the petroleum feedstock prior to contacting the present layered catalyst system. The petroleum feedstock, whether pretreated or not, contacts the first layer catalyst at hydrocracking conditions, including a first reaction temperature. During hydrocracking over the first catalyst layer, the temperature of the reacting oil, and the catalyst which it contacts, generally increases due to the exothermic nature of the reactions occurring on the catalyst, with the effect that the reaction temperature generally increases in the direction of reactant flow through the catalyst layer. It can therefore be seen that the first reaction temperature is the measured temperature of the oil at first contact with the first catalyst layer, or the measured temperature of the catalyst which first contacts the oil in the first catalyst layer. Under conditions such that the oil temperature contacting the first layer catalyst is non-uniform, the first reaction temperature is suitably an average temperature of the petroleum feedstock entering the first catalyst layer.

In the invention, the effluent from the first catalyst layer contacts a second catalyst layer of this invention. The first catalyst layer may be separated from the second layer by one or more catalyst layers, or by mechanical features of the reactor vessel, such as catalyst trays, quench injection means, distributor trays and the like, which are well-known. Such features may also include support layers of catalyst other than the layered catalysts of this invention. In a preferred practice of the present invention, such support or catalyst layers, if present, serve to contribute to improved flow characteristics of the reactants passing through the layered catalyst system.

At least a portion of, and preferably the entire effluent from the first catalyst layer contacts the second catalyst layer. As with the first layer, the oil passing through the second catalyst layer generally increases in temperature due to the exothermic hydrocracking reactions occurring there. It can be seen, therefore, that a second reaction temperature, which is the temperature of the oil exiting the second layer or alternatively the maximum measured temperature of the second layer catalyst, will be generally higher than the first reaction temperature in the first catalyst layer. According to the invention, it has been surprisingly discovered that the advantage of the present layered catalyst system, in terms of catalytic performance and middle distillate selectivity, improves relative to conventional catalyst systems as the temperature profile, i.e. the temperature difference between the second reaction temperature and the first reaction temperature, increases.

The layered catalyst system of the present invention comprises at least two catalyst layers. Each of the two catalyst layers contains an active hydrocracking catalyst comprising a cracking component, including a Y-type zeolite, and a hydrogenation component on an oxide support material.

The first layer catalyst comprises a zeolite having a unit cell size of greater than about 24.35 Angstroms, preferably in the range of 24.40–24.60 Angstroms, e.g. 24.55 Angstroms. The unit cell size of the Y-type zeolites present in the catalyst compositions may suitably be determined using ASTM-D-3492, the zeolite being present in its $NH4^+$ form. One of the zeolites which is considered to be a good starting material for the manufacture of hydrocracking catalysts is the well-known synthetic zeolite Y as described in U.S. Pat. No. 3,130,007, issued Apr. 21, 1964. A number of modifications to this material have been reported, one of which is ultrastable Y zeolite as described in U.S. Pat. No. 3,536,605, issued Oct. 27, 1970. To further enhance the utility of synthetic Y zeolite, additional components can be added. For example, U.S. Pat. No. 3,835,027, issued on Sept. 10, 1974 to Ward, et al., describes a hydrocracking catalyst containing at least one amorphous refractory oxide, a crystalline zeolitic aluminosilicate and a hydrogenation component selected from the Group VI and Group VIII metals and their sulfides and their oxides. The preferred first Y-type zeolite further has a bulk $SiO_2/Al_2O_3$ within the range of about 3 to about 30, preferably in the range of about 4 to about 12, more preferably in the range of about 5 to about 8, wherein the $SiO_2/Al_2O_3$ is based on a bulk elemental analysis of the silicon and the aluminum in the zeolite.

The second layer catalyst comprises a zeolite having a unit cell size of less than about 24.30 Angstroms, preferably in the range of 24.20–24.25 Angstroms. One of the zeolites which is considered to be a good starting material for the manufacture of the zeolitic catalyst particles is described in U.S. Pat. Nos. 5,059,567 and 5,246,677, the disclosures of which are incorporated herein by reference for all purposes. The zeolite-containing catalyst particles may be prepared using conventional methods. One such method is described in U.S. application Ser. No. 07/870,011, filed by M. M. Habib et al. on Apr. 15, 1992, and now abandoned, the disclosure of which is incorporated herein by reference for all purposes. The preferred second Y-type zeolite further has a bulk $SiO_2/Al_2O_3$ of greater than about 20 and preferably greater than about 35, wherein the $SiO_2/Al_2O_3$ is based on a bulk elemental analysis of the silicon and the aluminum.

While not identical, the first layer catalyst, which contains the zeolite having a unit cell size greater than about 24.35 Angstroms, and the second layer catalyst, which contains the zeolite having a unit cell size less than about 24.30 Angstroms, may be considered similar to each other, to the extent that the description, composition and method of preparation as disclosed herein apply equally to both, unless stated otherwise.

In addition to the zeolitic cracking component, the first layer catalyst and the second layer catalyst may also include an amorphous cracking component. The preferred amorphous cracking component is silica-alumina, containing typically between 10 and 90 weight percent silica, preferably between 15 and 65 weight percent silica, and more preferably between about 20 and 60 weight percent silica, the remainder being alumina. A cracking component containing in the range from about 10% to about 80% by weight of the Y-type zeolite and from about 90% to about 20% by weight of the amorphous cracking component is preferred. Still more preferred is a cracking component containing in the range from about 15% by weight to about 50% by weight of the Y-type zeolite, the remainder being the amorphous cracking component. Also, so-called x-ray amorphous zeolites (i.e., zeolites having crystallite sizes too small to be detected by standard x-ray techniques) can be suitably applied as cracking components.

The hydrogenation component of the zeolite catalyst particles is selected from those elements known to provide catalytic hydrogenation activity. At least one metal component selected from the Group VIII (IUPAC Notation) elements and/or from the Group VI (IUPAC Notation) elements are generally chosen. Group V elements include chromium, molybdenum and tungsten. Group VIII elements include iron, cobalt, nickel, ruthenium, rhodium, palladium, osmium, iridium and platinum. The amount(s) of hydrogenation component(s) in the catalyst suitably range from about 0.5% to about 10% by weight of Group VIII metal component(s) and from about 5% to about 25% by weight of Group VI metal component(s), calculated as metal oxide(s) per 100 parts by weight of total catalyst, where the percentages by weight are based on the weight of the catalyst before sulfiding. The hydrogenation components in the catalyst may be in the oxidic and/or the sulphidic form. If a combination of at least a Group VI and a Group VIII metal component is present as (mixed) oxides, it will be subjected to a sulfiding treatment prior to proper use in hydrocracking. Suitably, the catalyst comprises one or more components of nickel and/or cobalt and one or more components of molybdenum and/or tungsten or one or more components of platinum and/or palladium. The more preferred zeolite-containing catalyst particles comprise from about 3%-10% by weight of nickel oxide and from about 5%-20% by weight molybdenum oxide. Most preferably, the zeolite-containing catalyst particles comprises from about 4%-8% by weight of nickel oxide and from about 8%–15% by weight molybdenum oxide, calculated as 1 part by weight of metal oxides per 100 parts by weight of total catalyst.

The catalyst particles of this invention are suitably prepared by blending, or co-mulling, active sources of hydrogenation metals with a binder. Examples of suitable binders include silica, alumina, clays, zirconia, titania, magnesia and silica-alumina. Preference is given to the use of alumina as binder. Other components, such as phosphorous, may be added as desired to tailor the catalyst particles for a desired application. The blended components are then shaped, such as by extrusion, dried and calcined at temperatures up to 1200° F. (649° C.) to produce the finished catalyst particles. Alternative, equally suitable methods of preparing the amorphous catalyst particles include preparing oxide binder particles, such as by extrusion, drying and calcining, followed by depositing the hydrogenation metals on the oxide particles, using methods such as impregnation. The catalyst particles, containing the hydrogenation metals, are then further dried and calcined prior to use as a hydrocracking catalyst.

The zeolite catalyst particles suitably comprise from about 20%–75% by weight of the cracking component, and sufficient binder to make up to 100%, wherein the percentages by weight are based on the total catalyst composition in the anhydrous oxide state. Preferably, the catalyst particles comprises from about 40%–70% by weight of the cracking component, and from about 35%–75% by weight of binder, with from about 55%–65% by weight of cracking component, and from about 10%–30% by weight of binder being particularly preferred.

The effective diameter of the zeolite catalyst particles are in the range of from about 1/32 inch to about 1/4 inch, preferably from about 1/20 inch to about 1/8 inch. The catalyst particles may have any shape known to be useful for catalytic materials, including spheres, cylinders, fluted cylinders, prills, granules and the like. For non-spherical shapes, the effective diameter can be taken as the diameter of a representative cross section of the catalyst particles. The zeolite catalyst particles will further have a surface area in the range of from about 50 to about 500 $m^2$/gram.

The first layer catalyst may also include catalyst particles different from the first zeolite-containing catalyst particles, and likewise the second layer catalyst. Catalyst particles suitable for inclusion in the catalyst layers include amorphous catalyst particles. These amorphous catalyst particles may be blended with the zeolite-containing catalyst particles in a randomly intermixed combination of at least two discrete particle catalysts. The amorphous catalyst particles may be a conventional hydrotreating catalyst of the type used to carry out hydrodenitrification and/or hydrodesulfurization reactions having substantially no cracking activity, that is they are non-zeolitic low activity catalysts. Those familiar with the art recognize that such catalysts generally are constituted by a metal from Group VI and a metal from Group VIII placed on a low activity oxide such as pure alumina or other low acidic support material. Other components, such as phosphorous, may be added as desired to tailor the catalyst particles for a desired application. Such catalysts are well known in the art. See, for example, U.S. Pat. No. 5,593,570, the entire disclosure of which is incorporated herein by reference for all purposes. While by amorphous may be taken to indicate the absence of a crystalline zeolite in the amorphous catalyst particles, it may also be taken to mean the effective absence of a zeolite, such as less than about 0.1wt %. The effective diameter of the amorphous catalyst particles are in the range of from about 1/32 inch to about 1/4 inch, preferably from about 1/20 inch to about 1/8 inch. A catalyst layer comprising a blend of zeolite and amorphous catalyst particles suitably contain a volumetric ratio of zeolite-containing catalyst particles to amorphous catalyst particles between about 90/10 and 10/90, preferably between about 25/75 and 75/25, like 50/50.

The first and the second catalyst layer may be in a single reactor or in separate reactors. In the preferred layered catalyst system the first catalyst layer is adjacent the second layer, such that reactants passing through the layered catalyst system contact the first catalyst layer, pass through the first catalyst layer and contact directly the second catalyst layer. Those skilled in the art will recognize that adjacent catalyst layers, as in the preferred embodiment, may be separated by mechanical devices such as catalyst trays, quench trays, or distribution trays, or by particles which are essentially inert to the reacting fluids at reaction conditions.

Catalyst layers in addition to the layered catalyst system may also be included. Such additional layers may include hydrotreating and/or hydrocracking catalysts which are known in the art.

In the present process, a petroleum feedstock is contacted at hydrocracking conditions with a first catalyst layer to produce a first effluent stream. In a preferred embodiment, the entire first effluent stream is contacted at hydrocracking conditions with a second catalyst layer to produce a second effluent stream. According to the invention, at least a portion of the second effluent stream is separated, e.g. by fractionation, to produce a middle distillate product. The second effluent stream may further contain lighter boiling fractions, such as gaseous hydrocarbons, naphtha and heavier fractions, including unreacted oil.

The effluent from the catalytic reaction zone containing the layered catalyst system of this invention comprises at least one normally gaseous product and at least one normally liquid hydrocrackate, which contains middle distillate products boiling above about 250° F. and below about 700° F. at atmospheric pressure. The gaseous component(s) of the effluent is predominately hydrogen, with smaller amounts of contaminants, including hydrogen sulfide and ammonia. The gaseous component(s) may be separated from the liquid component(s) following reaction, and treated, such as by an aqueous and/or alkaline solution wash, to remove ammonia and hydrogen sulfide. The purified hydrogen stream may then be recycled to the catalytic reaction zone. The hydrocrackate is generally processed further, such as by a second stage of hydrocracking, or by fractionation for recovery of desired streams, or by both. Unreacted or partially reacted portions of the hydrocrackate may be recycled with the feed to the reaction zone for additional hydroconversion over the present layered catalyst system. Such processes are well known in the refining arts, and do not require additional description.

EXAMPLES

Example 1

A zeolite-containing catalyst of the invention was prepared as follows:

321 grams silica-alumina powder (30/70 $SiO_2$–$Al_2O_3$ purchased from Condea), and 151 grams CBV-760 zeolite (unit cell size=24.2 Angstroms, a $SiO_2/Al_2O_3$ bulk ratio of approximately 35, purchased from Condea), an acidified solution containing 41.4 grams of nickel, a solution containing 78.5 grams molybdenum and sufficient catapal alumina to make shaped particles were combined in a Baker Perkins mixer and extruded using a Bonnot extruder. The extrudates were dried at 320° F. for one hour and heated in 2 cubic feet per minute dry air at 950° F. in one hour and held at 950° F. for an additional hour before being cooled. The catalyst particles of Example 1 were labeled Catalyst A.

Example 2

A zeolite-containing catalyst useful for this invention was prepared using a procedure similar to Example 1. The zeolite used had a characteristic unit cell size of 24.5 Angstroms and a $SiO_2/Al_2O_3$ bulk ratio of approximately 5.5. The catalyst particles of Example 2 were labeled Catalyst B.

Example 3

A hydrotreating catalyst useful for this invention was prepared as follows:

1009 grams (volatile free basis) Katalco's GAP-50 alumina were acidified and mixed for 30 minutes. The acidified mixture was then neutralized with ammonia and extruded. The extrudates were dried for two hours at 250° F., for two hours at 400° F., and for one hour at 1500° F. The extrudates were impregnated with a solution containing 9.7 grams nickel, 42.0 grams molybdenum and 11.5 grams phosphorous. After standing for 20 minutes, the impregnated extrudates were dried at 200° F. for four hours and calcined at 950° F. for several hours. A commercially available amorphous catalyst, similar to that of Example 3 and containing 3% NiO, 21% $MoO_3$ and 3% $P_2O_5$, was labeled Catalyst C.

Petroleum Feedstock

A petroleum feedstock having the following properties was prepared:

TABLE I

| | |
|---|---|
| Gravity, API | 20.9 |
| Nitrogen, ppm | 2404 |
| Sulfur, wt % | 0.787 |
| Simulated Distillation (D1160), corrected to 760 mm pressure | |
| IBP | 443° F. |
| 10% | 622° F. |
| 30% | 699° F. |
| 50% | 760° F. |
| 70% | 820° F. |
| 90% | 860° F. |
| End | 901° F. |

Catalyst systems were prepared as follows:

Catalyst System I of this invention had two layers. The first layer was a uniform 50/50 (v/v) blend of high unit cell size zeolite catalyst (Catalyst B) and hydrotreating catalyst (Catalyst C). The second layer was a uniform 50/50 (v/v) blend of low unit cell size zeolite catalyst (Catalyst A) and hydrotreating catalyst (Catalyst C). Each layer comprised about 50% by volume of the entire system.

Comparative Catalyst System II was a uniform 50/50 (v/v) blend of low unit cell size zeolite catalyst (Catalyst A) and hydrotreating catalyst (Catalyst C). Comparative Catalyst System III was a uniform 50/50 (v/v) blend of high unit cell size zeolite catalyst (Catalyst B) and hydrotreating catalyst (Catalyst C). In the following examples the catalyst systems were compared for jet fuel selectivity and for catalyst fouling rate.

Example IV

Each catalyst system was tested for jet selectivity. Catalyst Systems I, II and III were each contacted in turn with the petroleum feedstock of Table I at a pressure of approximately 2275 psig, a feed rate of 1.5 $hr^{-1}$ LHSV and a recycle gas rate of 5400 SCF/bbl. The selectivity of the catalyst for making jet fuel was evaluated by determining the volume percent of the product which boiled in the jet fuel range (280° F.–525° F.), as a function of reaction conversion below 525° F., with the nitrogen in the product being controlled to a constant 1 ppm. Results are displayed graphically in FIG. 1. Over the full range of conversions, Catalyst System III, with the high unit cell size zeolite catalyst, had the poorest selectivity for jet fuel. Catalyst System II, with the low unit cell size zeolite catalyst, had higher selectivity for preparing the middle distillate fuel. Remarkably, layered Catalyst System I, with 50% of a high unit cell size zeolite catalyst layer and 50% of a low unit cell size zeolite catalyst layer, had effectively the same selectivity as Catalyst System II. This suggests that the layered system, containing a significant amount of the lower priced high unit cell size zeolite catalyst was equal in performance to the more costly Catalyst System II having effectively double the amount of low unit cell size zeolite catalyst.

Example V

Figure 2:
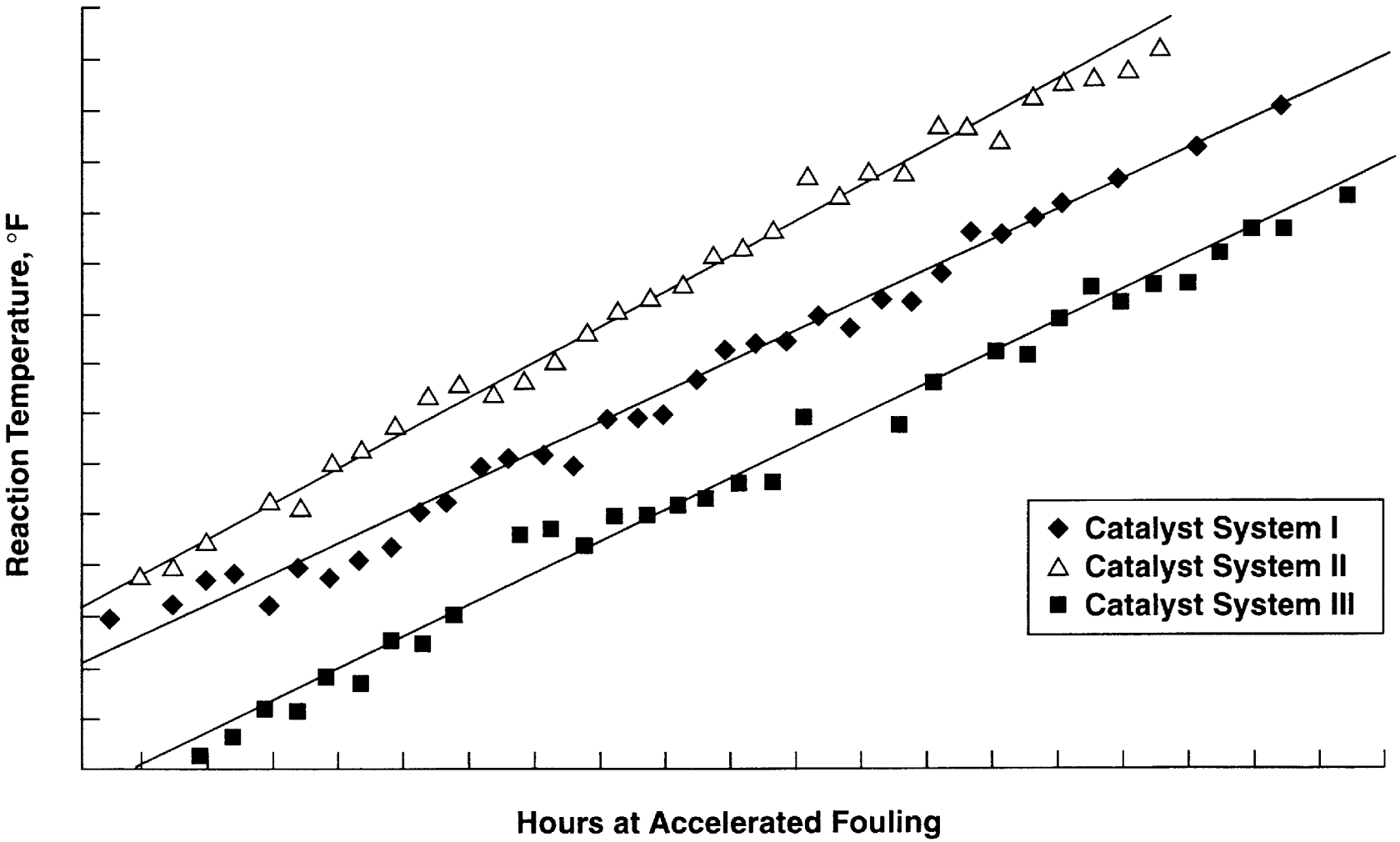

Catalyst systems I, II and III were also tested in an accelerated aging test. In this test each catalyst system was contacted with a vacuum gas oil feedstock at conditions chosen to quickly age the catalysts. The results are illustrated graphically in FIG. 2. Several features in FIG. 2 are worth noting. The activity of the layered Catalyst System I was intermediate between the activities of Catalyst Systems II and III. The low unit cell size zeolite catalyst (Catalyst System II) fouled at the highest rate, as indicated by the slope of the line for Catalyst System II in FIG. 2. Remarkably, the layered catalyst system I fouled at the same rate as the high unit cell size zeolite catalyst. This indicates that the layered catalyst, while providing the high jet selectivity of the low unit cell size zeolite catalyst, has the fouling resistance of the high unit cell size zeolite catalyst.

TABLE II

| Temperature | Catalyst System I | | | Catalyst System II | | | |
|---|---|---|---|---|---|---|---|
| Profile, ° F. | 0 | 80 | 110 | 0 | 40 | 80 | 110 |
| Yields | | | | | | | |
| $C_1$–$C_4$ Gases, Wt % | 0.9 | 1.5 | 1.8 | 1.0 | 1.2 | 2.2 | 3.9 |
| Naphtha, Vol % | 5.2 | 8.8 | 10.2 | 5.6 | 6.2 | 13.7 | 19.3 |
| Jet, Vol % | 20.7 | 28.9 | 30.4 | 19.6 | 21.8 | 26.6 | 29.6 |
| Conversion, Vol % | 19.4 | 30.8 | 33.6 | 19.6 | 20.2 | 32.8 | 41.6 |
| Jet/Naphtha ratio | 4.0 | 3.3 | 3.0 | 3.5 | 3.5 | 1.9 | 1.5 |

Example VI

The improved performance of the layered catalyst system is illustrated further in a test to determine what effect an increasing temperature profile had on the performance of the catalyst, where the temperature profile was the temperature difference between the bottom and the top of the catalyst system being tested. In each test the petroleum feedstock of Table I was passed over the test catalyst at 1.0 $hr^{-1}$ LHSV feed rate and at 2300 psig total pressure.

Catalyst Systems I and II, as defined above, were tested at isothermal conditions and at increasing temperature profiles of up to 110° F., to simulate typical commercial operations. Results are shown in Table II. According to this test, a high jet/naphtha ratio, and a low amount of $C_1$–$C_4$ light gas is indicative of high liquid and jet selectivities. When a temperature profile was imposed on the two catalyst systems, the improved performance of the catalysts of this invention was remarkable. Changing from an isothermal reactor to one having a 110° F. profile resulted in roughly a two-fold increase (1.8/0.9=2.0) in gas ratio for Catalyst System I, and roughly a four-fold increase (3.9/1.0=3.9) in gas make for Catalyst System II. Jet/naphtha ratio was also twice as high for Catalyst System I compared to Catalyst System II when operating with 110° F. temperature profile on these catalysts.

What is claimed is:

1. A hydrocracking process comprising contacting a petroleum feedstock and hydrogen at hydrocracking conditions with a first catalyst layer which contains catalyst particles comprising a Y-type zeolite having a unit cell size of greater than about 24.35 Angstroms and contacting the entire effluent from the first catalyst layer at hydrocracking conditions with a second catalyst layer which contains catalyst particles comprising a Y-type zeolite having a unit cell size of less than about 24.30 Angstroms.

2. The hydrocracking process according to claim 1 further comprising recovering a middle distillate product.

3. The hydrocracking process according to claim 1 wherein the catalyst particles in the first catalyst layer comprise a Y-type zeolite having a unit cell size in the range of from about 24.40 Angstroms to about 24.60 Angstroms.

4. The hydrocracking process according to claim 1 wherein the catalyst particles in the second catalyst layer comprise a Y-type zeolite having a unit cell size in the range of from about 24.20 Angstroms to about 24.30 Angstroms.

5. The hydrocracking process according to claim 1 at hydrocracking conditions, including a reaction temperature in the range of from about 250° C. to about 500° C., pressures up to about 300 bar and space velocities from about 0.1 to about 10 kg feed per liter of catalyst per hour (kg/1h).

6. The hydrocracking process according to claim 1 wherein the zeolite-containing catalyst particles in the first catalyst layer comprise from about 0.5% to about 10% by weight of Group VIII metal component(s), from about 5% to about 25% by weight of Group VI metal component(s), from 20–75% by weight of a cracking component, and sufficient binder to make up to 100%.

7. The hydrocracking process according to claim 6 wherein the cracking component comprises from about 15% by weight to about 50% by weight of the Y-type zeolite having a unit cell size of greater than about 24.35 Angstroms.

8. The hydrocracking process according to claim 1 wherein the zeolite-containing catalyst particles in the second catalyst layer comprise from about 0.5% to about 10% by weight of Group VIII metal component(s), from about 5% to about 25% by weight of Group VI metal component (s), from 20–75% by weight of a cracking component, and sufficient binder to make up to 100%.

9. The hydrocracking process according to claim 8 wherein the cracking component comprises from about 15% by weight to about 50% by weight of the Y-type zeolite having a unit cell size of less than about 24.30 Angstroms.

10. The hydrocracking process according to claim 1 wherein the first catalyst layer further comprises amorphous catalyst particles, wherein the volumetric ratio of zeolite-containing catalyst particles to amorphous catalyst particles is between about 90/10 and 10/90.

11. The hydrocracking process according to claim 10 wherein the volumetric ratio of zeolite-containing catalyst particles to amorphous catalyst particles is between about 25/75 and 75/25.

12. The hydrocracking process according to claim 1 wherein the second catalyst layer further comprises amorphous catalyst particles, wherein the volumetric ratio of zeolite-containing catalyst particles to amorphous catalyst particles is between about 90/10 and 10/90.

13. The hydrocracking process according to claim 12 wherein the volumetric ratio of zeolite-containing catalyst particles to amorphous catalyst particles is between about 25/75 and 75/25.

14. A hydrocracking process comprising contacting a petroleum feedstock with hydrogen at hydrocracking reaction conditions, including a first reaction temperature, over a first layer catalyst comprising a Y-type zeolite having a unit cell size of greater than about 24.35 Angstroms, and contacting at least a portion of the effluent from the first layer catalyst with hydrogen at hydrocracking reaction conditions, including a second reaction temperature, over a second layer catalyst comprising a Y-type zeolite having a unit cell size of less than about 24.30 Angstroms, wherein the second reaction temperature is at least about 40° F. higher than the first reaction temperature.

15. The hydrocracking process according to claim 14 wherein the second reaction temperature is at least about 60° F. higher than the first reaction temperature.

16. A hydrocracking process comprising contacting a sulfur and nitrogen containing petroleum feedstock with hydrogen at hydrocracking conditions, including a reaction temperature in the range of from about 250° C. to about 500° C., pressures up to about 300 bar and space velocities from about 0.1 to about 10 $hr^{-1}$, over a first zeolitic catalyst layer comprising a first zeolite catalyst particles which contain a Y-type zeolite having a unit cell size of greater than about 24.35 Angstroms, and contacting the entire effluent from said first zeolitic catalyst layer with hydrogen at hydrocracking conditions over a second zeolitic catalyst layer comprising a second zeolite catalyst particles which contain a Y-type zeolite having a unit cell size of less than about 24.30 Angstroms.

17. The hydrocracking process according to claim 16 wherein the petroleum feedstock contains greater than 100 ppm nitrogen and greater than 0.15 wt % sulfur.

18. A hydrocracking process comprising contacting a petroleum feedstock and hydrogen at hydrocracking conditions with a layered catalyst system contained within a catalytic reaction zone, the feedstock containing greater than about 100 ppm nitrogen and greater than about 0.15 wt % sulfur, the layered catalyst system comprising a first catalyst layer which contains catalyst particles comprising a Y-type zeolite having a unit cell size of greater than about 24.35 Angstroms and a second catalyst layer which contains catalyst particles comprising a Y-type zeolite having a unit cell size of less than about 24.30 Angstroms.

19. The hydrocracking process according to claim 18 comprising:

a) contacting the petroleum feedstock at hydrocracking conditions with the first catalyst layer to produce a first effluent stream;

b) contacting the entire first effluent stream at hydrocracking conditions with the second catalyst layer to produce a second effluent stream; and c) separating at least a portion of the second effluent stream to produce a middle distillate product.

* * * * *